United States Patent [19]

Nabinger

[11] Patent Number: 4,796,774

[45] Date of Patent: Jan. 10, 1989

[54] REMOVABLE AND RESEALABLE LID FOR A CONTAINER

[75] Inventor: Richard Nabinger, Utica, Mich.

[73] Assignee: The Answer Company, Warren, Mich.

[21] Appl. No.: 74,065

[22] Filed: Jul. 16, 1987

[51] Int. Cl.[4] ..... A47G 19/22

[52] U.S. Cl. ..... 220/90.4; 220/339; 220/90.2; 220/85 SP; 222/192; 222/542

[58] Field of Search ..... 220/90.2, 90.4, 90.6, 220/85 SP, 375, 339; 222/192, 542, 570, 569, 88, 89

[56] References Cited

U.S. PATENT DOCUMENTS

| | | | |
|---|---|---|---|
| 1,477,936 | 12/1923 | Bott | 220/85 SP |
| 1,965,356 | 7/1934 | Rittenhouse | 221/23 |
| 2,550,568 | 4/1951 | Kersh | 128/252 |
| 2,617,563 | 11/1952 | Miller | 222/528 |
| 3,154,226 | 10/1964 | Petitto | 222/528 |
| 4,014,465 | 3/1977 | Ritter | 222/563 |
| 4,090,660 | 5/1978 | Schram et al. | 229/43 |
| 4,219,137 | 8/1980 | Hutchens | 222/462 |
| 4,478,346 | 10/1984 | Spong | 220/90.2 |
| 4,561,557 | 12/1985 | Park et al. | 220/90.2 |
| 4,703,873 | 11/1987 | Geren | 220/90.2 |

*Primary Examiner*—George T. Hall
*Attorney, Agent, or Firm*—Basile and Hanlon

[57] ABSTRACT

A resealable cover for snap-fitting on a container comprising the combination of a resilient disk member with a downwardly extending lip integrally formed on the circumference thereof, and a spout integrally formed on an upper surface thereof said spout extending beyond the circumferential surface of the container when the cover is snap-fit thereon, and a spout cover pivotally mounted to the spout and sealable therewith. By snap-fitting the sealable cover to the top of an open container, for example, a beverage container, a sanitary means is formed for drinking therefrom. Alternatively, the spout may be used to pour the contents of the container. The container may then be resealed by sealing the spout cover to the spout to prevent, for example, escape of carbonation from the beverage contained in the container.

2 Claims, 1 Drawing Sheet

REMOVABLE AND RESEALABLE LID FOR A CONTAINER

BACKGROUND OF THE INVENTION

1. Field of the Invention

The present invention relates to a removable and resealable cover for a container and more particularly to such a cover having a spout integrally formed thereon and a spout cover pivotally mounted to the spout and sealable therewith.

2. Description of the Prior Art

The popularity of soft drinks and other beverages which are sold in a container from which the beverage is to be directly consumed has been steadily increasing in recent years. One very popular form of such a beverage container is a cylindrical can formed of a thin walled metal such as aluminum. Typically, such a beverage can features a so-called "pop-top" opening tab affixed to an upper planar surface thereof. The opening tab may be removed to expose an opening in the upper surface of the can. This type of beverage container is used for soft drinks, beer, fruit juices, iced tea and iced tea mixtures, carbonated waters, mineral waters, fruit juice based drinks, punch-type drinks carbonated beverages, etc.

One problem which arises with the use of this type of beverage can is that once the pop top is removed and the drinking opening exposed, no means is provided for resealing the opening. If it is desired, for example, to drink part of the beverage and reserve the rest for later use, the user will be unable to effectively seal the remaining contents of the can. If the can is used to contain a carbonated beverage, the beverage will quickly go "flat" in its unsealed, opened condition due to escape of carbon dioxide gas therefrom. Generally, any of the beverage not consumed upon first opening the container or shortly thereafter will have to be discarded.

An additional problem arises with beverage containers of this type in that no provision is made for a clean and sanitary means of drinking the beverage. The user must drink the contents of the container directly through the opening exposed in the top by removing the opening tab thereof. Thus, the user's mouth, tongue and lips come in direct contact with the various surfces of the container. Since the container may come in contact with many unsanitary and disease bearing sources during its manufacture, processing and subsequent handling, there is a potential risk of contamination. The only choices the user of such a container has heretofore had is either risking contamination or pouring the contents of the container into, a glass.

Several attempts have been made to solve the problem of providing a sanitary means of drinking from such a container. For example, U.S. Pat. No. 4,561,557 discloses a beverage container having an enclosed spout which is automatically released from the container when it is opened by pulling back the opening tab thereof. The user's lips and mouths can use the drinking spout without contacting the top or walls of the container while drinking the contents from the container, thereby avoiding contamination. However, the enclosed spout disclosed in this patent must be provided on the can as part of the manufacturing process. The spout may not be attached to the can by the consumer at the time of use. Therefore, the problem of sanitary drinking from a conventional beverage container is not addressed by this patent.

U.S. Pat. No. 4,219,137 discloses an extendable spout for a container formed of blown plastic in which the top of the container is formed of convoluted plastic which may be nested into the container. The spout may be extended from the container by expanding the convolutions to form a convenient pouring spout or funnel. However, in addition to the problem of the spout being formed in the manufacturing process, the container disclosed herein is a blown plastic container which is unsuitable for many types of carbonated beverages.

U.S. Pat. Nos. 2,550,568 and 4,090,660 disclose lids which may be attached to conventional containers. The lid of the first mentioned patent includes an extended spout which may be drunk from. The lid of the second mentioned patent includes a pair of radial score lines which can be torn to form a liftable tab so a person can drink from the container while the lid is still on; the tab being pivotal so to fit on the cover in order to close it.

However, neither U.S. Pat. No. 2,550,568 nor 4,090,660 discloses a means of resealing the lid so that carbonation may not escape from the contents of the container. The pivotable tab formed integral on the lid of U.S. Pat. No. 4,090,660 may be re-closed but, since no provision is made for a sealing closure, the closed lid will not prevent the escape of carbonation.

It would be desirable to provide means by which the user of a beverage container may safely and sanitaryily drink therefrom, which means may be mounted by the user on the container at the time of use.

It would also be desirable to provide means for resealing a container after opening thereof to prevent loss of carbonation of the contents and/or to prevent accidental spillage and leakage thereof.

It would be highly desirable to provide a sanitary means of drinking from a container which may be mounted to the container at the time of use and which may be resealed to prevent loss of carbonation of the contents thereof.

SUMMARY OF THE INVENTION

The device disclosed and claimed herein is a resealable cover for a beverage or other container which has integrally formed thereon a spout which extends beyond the circumferential surface of the container. A spout cover is pivotally mounted to the spout and is sealable therewith.

In one embodiment of the instant invention, the resealable cover may be snap-fit over an upper surface of a cylindrical beverage container. The resealable cover is disk-shaped and is formed of a resilient sheet material such as a sheet plastic of the polyethylene type. Integrally formed on the circumference thereof is a downwardly extending lip. The function of the downwardly extending lip is to insure a snap-fit with the container when the resealable cover is mounted over the top thereof. A spout is integrally formed on the upper surface of the resealable cover and extends beyond the circumferential surface of the container when the cover is snap-fit thereon. A spout cover is pivotally mounted to the spout and is sealable therewith. The spout cover may be either integral with the spout and pivotal around a thin portion disposed adjacent the spout, or it may be formed separately and pivotal with the spout by means of a conventional hinge.

Means for sealing the spout cover with the spout may be provided. In one embodiment, the sealing means comprises a sealing ridge formed on the outer surface of the spout and a downwardly extending periphery formed on the spout cover which is adapted to sealingly engage the sealing ridge formed on the spout.

The removable and resealable container cover of the present invention may be manufactured in a plurality of sizes to fit standard size beverage containers. Since the design of the instant device is simple and the material of which it is made is relatively inexpensive, it is contemplated that manufacturing costs would be very low. However, it is likely that potential users will wish to reuse the removable container cover for a plurality of uses. The instant cover may be easily removed from an empty beverage container, washed in a dishwasher or by hand, and compactly stored for later use.

BRIEF DESCRIPTION OF THE DRAWINGS

The various features, advantages and other uses of the present invention will become more apparent by referring to the following detailed description and drawings.

DETAILED DESCRIPTION OF THE PREFERRED EMBODIMENTS

Figure 1:
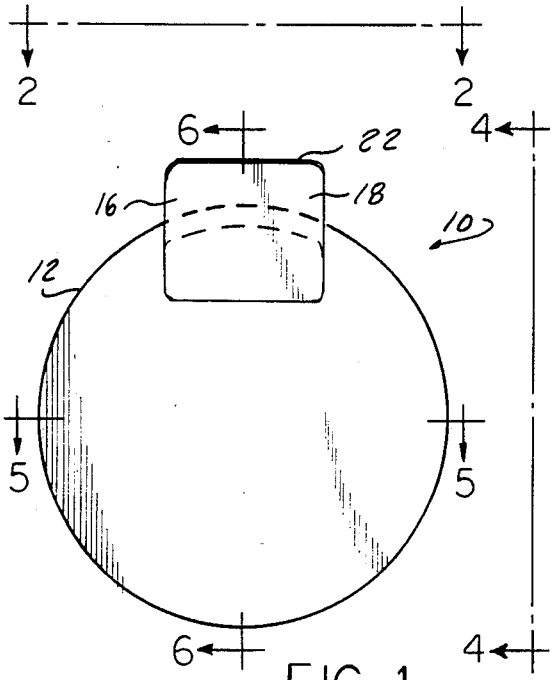
FIG. 1 is a plan view of a removable and resealable beverage container in accordance with the present inventon.

Reference is made to FIGS. 1–6 in which like numbered reference numerals are used to delineate the same feature in multiple figures thereof. In FIG. 1 there is depicted a beverage container cover 10 comprising a flat disk shape member 12 and a spout 16 formed integrally thereon. As may be seen by reference to FIGS. 1 and 4, spout 16 forms a generally rectangular opening through disk shaped member 12 having a flat pouring surface which extends beyond the circumference of disk shaped member 12. This design enables the user to more easily drink from spout 16 when the beverage container cover 10 is mounted on the top of a beverage container (not shown). Typically, beverage container cover 10 will be formed of a resilient sheet material, such as a polyethylene-type of plastic.

Figure 3:
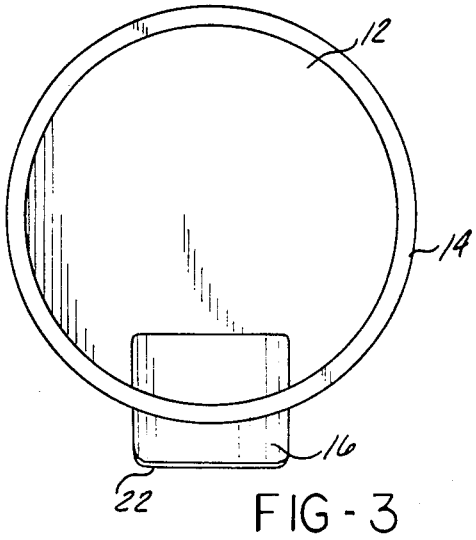
FIG. 3 is a bottom view of the beverage container cover of FIG. 1.
Figure 2:
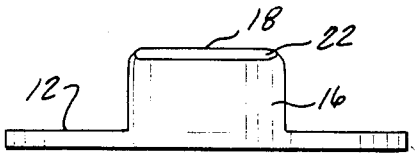
FIG. 2 is a front view of the beverage container cover of FIG. 1 taken along lines 2—2 of FIG. 1.
Figure 5:
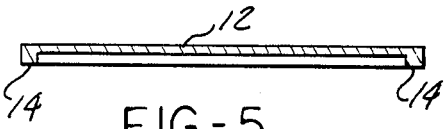
FIG. 5 is a cross-sectional view of the beverage container cover of FIG. 4 taken along lines 5—5 of FIG.

As may be seen by referring to FIGS. 3 and 5, a downwardly extending lip 14 is integrally formed on the circumference of disk shaped member 12. The purpose of lip 14 is for engagement of the side walls of a beverage container when container cover 10 is mounted over the top thereof. The engagement of lip 14 with the side walls of the beverage container will create a snap-fit therebetween.

Figure 4:
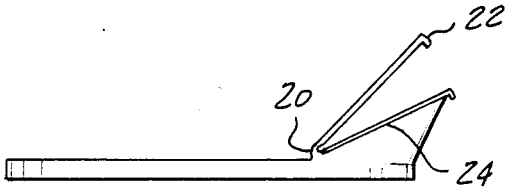
FIG. 4 is a right side view of the beverage container cover of FIG. 1 taken along lines 4—4 of FIG. 1.
Figure 6:
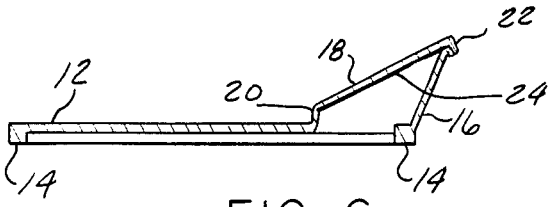
FIG. 6 is a partial cross-sectional view of the beverage continer cover of FIG. 2 taken along lines 6—6 of FIG. 1.

As may be seen with reference to FIGS. 4 and 6, a spout cover 18 is pivotally mounted on spout 16. In the embodiment depicted in FIGS. 4 and 6, the pivotal mounting is formed by hinge 20 which is a narrowed section of the resilient sheet material. In this embodiment, spout cover 18 is actually integral with spout 16. Alternatively, any means of pivotally mounting spout cover 18 to spout 16 may be provided, such as a conventional hinge (not shown).

A sealing edge 24 will be formed on an outer surface of te spout 16 and adjacent a top edge thereof, as is depicted in FIG. 6. A downwardly extending periphery 22 is integrally formed on the spout cover 18 and is adapted to sealingly engage the sealing edge 24.

To use the beverage container cover 10 of the instant invention, the beverage container is first opened, typically by opening the tab closure thereof. The beverage container cover 10 is then snap-fit onto the top of the beverage container by engagement of lip 14 with the side walls thereof. The spout lid 18 is then pivoted open. The user may then easily drink the beverage in the container from extended spout 16. If it is desired to reserve some of the contents of the beverage container for later enjoyment, the spout is sealed by engaging downwardly extending periphery 22 formed on spout cover 18 with sealing ridge 20 formed on the spout. By sealing spout 16 with spout cover 18, carbonation is prevented from escaping the beverage and/or off flavors of the beverage are prevented from developing.

The beverage container cover of the instant invention has the additional advantage of preventing accidental spillage and leakage of the beverage from the container.

While the beverage container cover of the instant invention has been described with reference to a standard aluminum, cylindrical beverage container can, it is by no means limited to a container of the type described, but may be applied to any type of beverage container on which it may be mounted. For example, instead of a disk shaped member 12, the beverage container cover could comprise a rectangular member with a downwardly extending lip to fit over a rectangular container, such as the type commonly used to contain, for example, olive oil. The herein disclosed container cover provides an easy method of providing a pourable or drinkable spout for many types of containers. Thus, while the herein invention is described with reference to certain embodiments and exemplifications thereof, it is not meant to be limited so, but solely by the claims appended hereto.

I claim:

1. A resealable container cover for engagement with a container comprising:

a resilient flat member having a downwardly extending sealing lip, integrally formed on the circumference thereof for sealing engagement with the outer rim of the container top;

a spout forming a generally rectangular opening through said flat member, integrally formed on the top surface of said flat member, having a flat pouring surface extending angularly upwardly from said top surface and beyond the circumference of said flat member, and having a spout sealing ridge, extending outwardly about the circumference of said spout opening;

a spout cover, pivotally mounted to the radially inward edge of said spout opening, having a downwardly extending sealing lip, integrally formed on the circumference thereof, for sealing engagement with said spout sealing ridge of said spout when pivoted into a closed position; and hinge means integrally formed between said spout and said spout cover at said radially inward edge of said spout opening.

2. The resealable container cover, defined in claim 1, wherein said hinge means comprises a section of resilient material of narrowed thickness.

* * * * *